United States Patent [19]

Yan

[11] Patent Number: 4,481,101

[45] Date of Patent: Nov. 6, 1984

[54] PRODUCTION OF LOW-METAL AND LOW-SULFUR COKE FROM HIGH-METAL AND HIGH-SULFUR RESIDS

[75] Inventor: Tsoung Y. Yan, Philadelphia, Pa.

[73] Assignee: Mobil Oil Corporation, New York, N.Y.

[21] Appl. No.: 411,141

[22] Filed: Aug. 25, 1982

Related U.S. Application Data

[63] Continuation-in-part of Ser. No. 224,778, Jan. 13, 1981, Pat. No. 4,334,976, which is a continuation-in-part of Ser. No. 186,927, Sep. 12, 1980, Pat. No. 4,317,711.

[51] Int. Cl.[3] ..... C10B 55/02

[52] U.S. Cl. ..... 208/50; 208/106; 208/107; 208/208 R; 208/209; 208/251 R; 208/251 H

[58] Field of Search ..... 208/251 H, 209, 106, 208/50, 72, 251 R, 52 R, 89, 107, 208 R

[56] References Cited

U.S. PATENT DOCUMENTS 2,358,573 9/1944 Hemminger ..... 208/50
3,773,653 11/1973 Nongbri et al. ..... 208/50
4,233,138 11/1980 Rollmann et al. ..... 208/106
4,411,770 10/1983 Chen et al. ..... 208/251 H

*Primary Examiner*—Delbert E. Gantz
*Assistant Examiner*—Anthony McFarlane
*Attorney, Agent, or Firm*—A. J. McKillop; M. G. Gilman; J. F. Powers, Jr.

[57] ABSTRACT

A process for demetallation and desulfurization of resids by visbreaking an admixture of resids, particulate solids, and steam and/or hydrogen, and then subjecting the visbroken mixture to high temperature settling and separating to provide a first vapor product, a liquid product, and a recycled underflow solids stream. The process further comprises coking the liquid product to produce a second vapor product and coke and then distilling the combined first and second vapor products to yield a plurality of demetallized and desulfurized liquid hydrocarbon products. A fraction of the recycled underflow from the settler/separator is removed as a purge stream and burned for recovery of heat and metals. If hydrogen is used in the visbreaking step, the first vapor product is condensed to separate the hydrogen for recycling.

20 Claims, 1 Drawing Figure

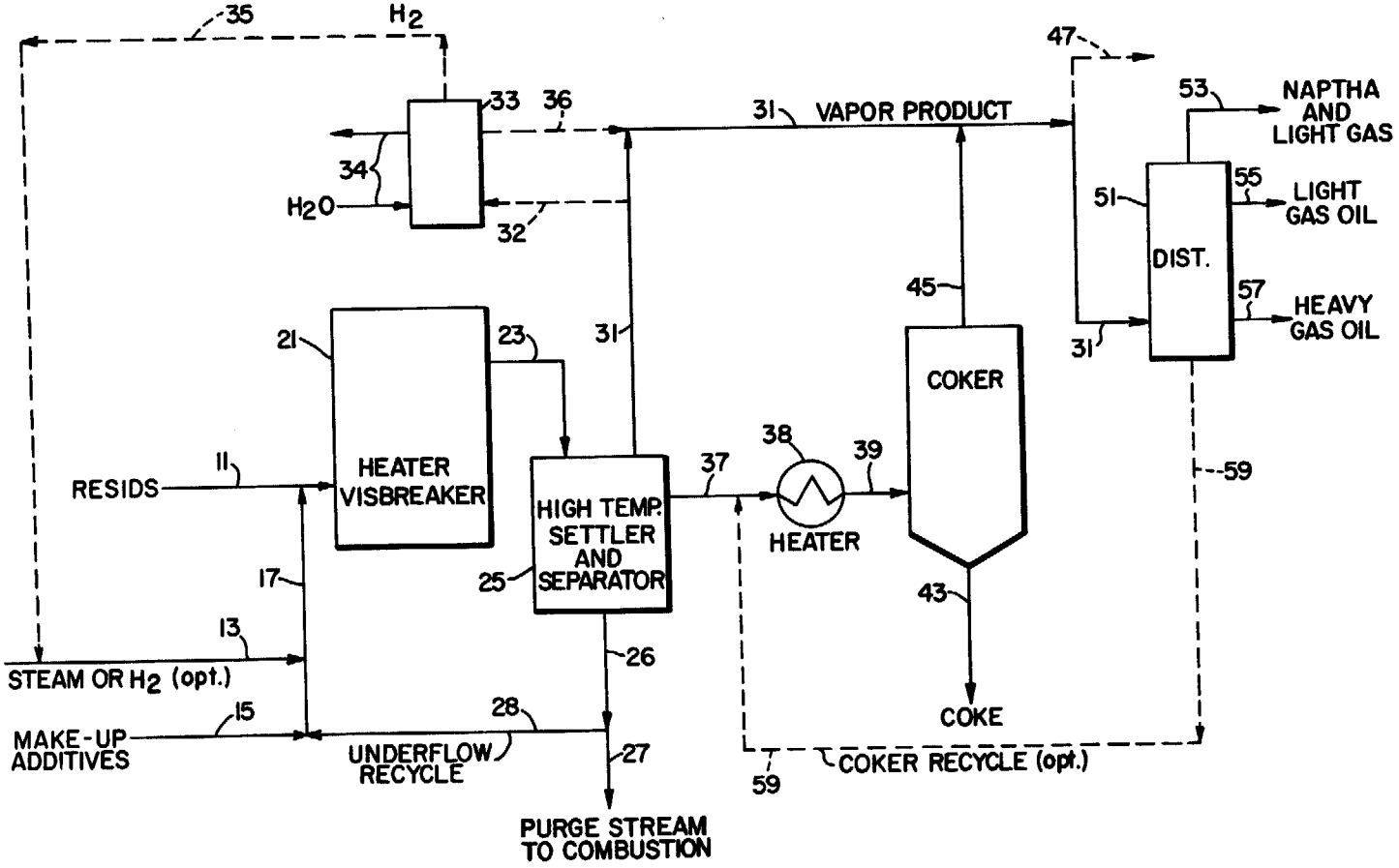
NAPTHA AND LIGHT GAS
LIGHT GAS OIL
HEAVY GAS OIL
DIST.
53
55
57
59
51
31
47
VAPOR PRODUCT
COKER
45
43
COKE
COKER RECYCLE (opt.)
39
38
HEATER
37
HIGH TEMP. SETTLER AND SEPARATOR
26
27
PURGE STREAM TO COMBUSTION
25
28
UNDERFLOW RECYCLE
23
HEATER VISBREAKER
21
36
33
32
34
H2
H2O
35
11
17
13
15
RESIDS
STEAM OR H2 (opt.)
MAKE-UP ADDITIVES

PRODUCTION OF LOW-METAL AND LOW-SULFUR COKE FROM HIGH-METAL AND HIGH-SULFUR RESIDS

This patent application is a continuation-in-part of patent application Ser. No. 224,778, filed Jan. 13, 1981, now U.S. Pat. No. 4,334,976, which is a continuation-in-part of patent application Ser. No. 186,927, filed Sept. 12, 1980, now U.S. Pat. No. 4,317,711.

BACKGROUND OF THE INVENTION

Residual petroleum oil fractions produced by atmospheric or vacuum distillation of crude petroleum are characterized by a relatively high metals content. This occurs because substantially all of the metals present in the original crude remain in the residual fraction. Principal metal contaminants are nickel and vanadium, with iron and small amounts of copper sometimes being present.

The high metals content of the residual fractions generally preclude their effective use as chargestocks for subsequent catalytic processing, such as catalytic cracking and hydrocracking, because the metal contaminants deposit on the special catalysts for these processes and cause the formation of inordinate amounts of coke, dry gas, and hydrogen.

It is current practice to upgrade certain residual fractions by a pyrolytic operation known as coking. In this operation the residuum is destructively distilled to produce distillates of low metals content and leave behind a solid coke fraction that contains most of the metals. Coking is typically carried out in a reactor or drum operated at about 800°-1100° F. temperature and a pressure of 1-10 atmospheres. The economic value of the coke byproduct is determined by its quality, particularly its sulfur and metals content. Excessively high levels of these contaminants make the coke useful only as low-valued fuel. In contrast, cokes of low metals content, for example up to about 100 ppm (parts per million by weight) of nickel and vanadium and containing less than about 2 weight percent sulfur, may be used in high-valued metallurgical, electrical, and mechanical applications.

Presently, catalytic cracking is generally accomplished by utilizing hydrocarbon chargestocks lighter than residual fractions which usually have an API gravity greater than 20. Typical cracking chargestocks are coker and/or crude unit gas oils, vacuum tower overhead, and the like, the feedstock having an API gravity from about 15 to about 45. Since these cracking chargestocks are distillates, they do not contain significant proportions of the large molecules in which the metals are concentrated. Such catalytic cracking is commonly carried out in a reactor operated at a temperature of about 800°-1500° F., a pressure of about 1-5 atmospheres, and a space velocity of about 1-100 WHSV.

The amount of metals present in a given hydrocarbon stream is often expressed as a chargestock's "metals factor". This factor is equal to the sum of the metals concentrations, in parts per million, of iron and vanadium plus ten times the concentration of nickel and copper in parts per million, and is expressed in equation form as follows:

$$F_m = Fe + V = 10(Ni + Cu)$$

Conventionally, a chargestock having a metals factor of 2.5 or less is considered particularly suitable for catalytic cracking. Nonetheless, streams with a metals factors of 2.5-25, or even 2.5-50, may be used to blend with or as all of the feedstock to a catalytic cracker, since chargestocks with metals factors greater than 2.5 in some circumstances may be used to advantage, for instance with the newer fluid cracking techniques.

In any case, the residual fractions of typical crudes will require treatment to reduce the metals factor. As an example, a typical Kuwait crude, considered of average metals content, has a metals factor of about 75 to about 100. As almost all of the metals are combined with the residual fraction of a crude stock, it is clear that at least about 80 percent of the metals and preferably at least 90 percent needs to be removed to produce fractions, having a metals factor of about 2.5-50, that are suitable for cracking chargestocks.

The economic and environmental factors relating to upgrading of petroleum residual oils and other heavy hydrocarbon feedstocks have encouraged efforts to provide improved processing technology, as exemplified by the disclosures of various U.S. Pat. Nos. which include 3,696,027; 3,730,879; 3,775,303; 3,876,530; 3,882,049; 3,897,329; 3,905,893; 3,901,792; 3,964,995; 3,985,643; 4,016,067, and the like.

Efforts have been made in the past to upgrade petroleum residual oils in the presence of solids. For example, U.S. Pat. No. 3,893,911 teaches the demetallization of residua by ebulliated bed catalytic hydrogenation in the presence of particulate activated porous aluminum oxide catalyst. As another example, inert particulate solids, including diatomaceous silica in the form of extruded pellets, are contacted by residua in the presence of hydrogen at 500°-850° F. and at 300-3,000 psig for removing metalliferous contaminants according to the process of U.S. Pat. No. 3,947,347, but the solids must have an average pore diameter of 1,000-10,000 A.

U.S. Pat. No. 4,259,178 teaches the delayed coking of a slurry mixture of a petroleum resid and 10-30 weight percent of caking or non-caking coal, blended at a temperature below 50° C. to produce a soft, porous, fusible, sponge-like cake.

Coking has long been the most important process for upgrading of resid. Because of worsening of crude quality and improvements in vacuum distillation and catalytic cracking technologies, the quality of coker feed has been deteriorating for years. At the present time, the low quality coke produced by some refineries has become difficult to market.

The important quality parameters of coke are metal and sulfur contents and physical structure, namely, shot coke. The high metal and sulfur contents make the coke not only unsuitable as high-value electrode coke but also as low-value fuel because the metals, particularly vanadium, cause boiler tube corrosion. In addition, the sulfur forms SOx and pollutes the air, and the shot coke creates difficulties in pulverization. The need for processes to produce high quality coke is consequently obvious.

Accordingly, it is a main object of this invention to provide a process for production of high quality and marketable coke, having low contents of metals and sulfur, from high metal and sulfur resids.

Another object is to recover the metal values of resids.

A further object is to minimize the environmental effects in production and utilization of coke.

Other objects and advantages of the present invention shall become apparent from the accompanying description and illustrated data.

DESCRIPTION OF THE INVENTION

One or more objects of the present invention are accomplished by the provision of a process for demetallation and desulfurization of resids which comprises (1) heating an admixture of resids and particulate solids under visbreaking conditions while adding steam and/or hydrogen; (2) subjecting the visbroken admixture to high temperature separating and settling to provide a first vapor product, an oil fraction, and a recycled underflow solids fraction; (3) coking the oil fraction to produce a second vapor product and coke; and (4) distilling the combined vapor products to yield a plurality of demetallized and desulfurized liquid hydrocarbon products.

Because provision is made in the process for metal, sulfur, and shot coke precursors to be separated from the residua, the feed entering the coker is low in metallic and sulfur contaminants, and coke of high quality is thereby produced. At least 75 weight percent of the constituents of petroleum oil residua have a boiling point above about 700° F. Typically, resids suitable for treatment in accordance with the present invention have a metals content of at least 50 ppm and a Conradson Carbon Residue content of at least 5 weight percent.

Many solids can be used as the additive. They include coals of various ranks, petroleum coke, limestone, dolomite, iron ores, silica, silica-alumina, zeolites, and the like, and mixtures thereof. When coal is used, it will be partially liquified and contribute to liquid yield. When iron ore or other metal oxides are used, they contribute to purification of the resid by scavenging sulfur from the liquid. When limestone or dolomite are used, they also remove sulfur.

Ball mills or other types of conventional apparatus may be employed for crushing and pulverizing coarse dolomite, limestone, coal, and the like in the preparation of the particulate solids feed for the visbreaking step (1) of the process. The crushing and grinding of the solids can be accomplished either in a dry state or in the presence of a liquid such as the heavy hydrocarbon oil being employed in the practice of the process. The average particle size of the solids feed is preferably below about 0.25 inch, such as finely divided bituminous coal which has a particle size of less than about 3 mesh (U.S. Sieve Series).

The coal component of the particulate solids can be any of a variety of carbonaceous materials which include bituminous and sub-bituminous types of coal, lignite, peat, and the like. The nominal analysis of typical coals is as follows:

| | |
|---|---|
| **Sub-Bituminous** | |
| Sulfur | 0.21% |
| Nitrogen | 0.88 |
| Oxygen | 15.60 |
| Carbon | 65.53 |
| Hydrogen | 5.70 |
| Ash | 3.99 |
| **Lignite** | |
| Sulfur | 0.53% |
| Nitrogen | 0.74 |
| Oxygen | 32.04 |
| Carbon | 54.38 |
| Hydrogen | 5.42 |
| Ash | 5.78 |

The resids feedstock is mixed with recycled solid carrier and heated to 700°-1000° F. in a heater which is suitably a tubular heater. In order to reduce coking of heater tubes, some steam (up to 10# bbl of feed) can be added. Hydrogen gas can be used in lieu of steam and has other beneficial effects. The residence time of the feed in the heater can be from 1 to 50 min. The effluent is passed to a high temperature separator and settler from which the gaseous or vapor product is recovered. The liquid/solid phases are separated into overflow and underflow.

The overflow is further heated, if necessary, to the coking temperatures of 800° to 1000° F. and is then introduced to the coking drum for delayed coking or to a fluid coker. Since the overflow is reduced greatly in metal and sulfur contents, the coke produced from the subsequent coking is low in both metal and sulfur contents. It was found that all the metal components (i.e., Ni, V, Na, Fe, etc.) are reduced greatly in quantity and roughly in equal proportion, i.e., about the same percentage of demetallation occurs for each contaminant. It is particularly important to note that the precursors for shot coke are also reduced in the overflow, so that shot-coke-free coke can be produced.

The underflow, which contains the solids additives and insolubilized metal and sulfur compounds, can be recycled to the heater for capturing more metal, sulfur, and precursors of shot coke. In order to control the contents of metal, sulfur, and shot coke precursors in the recycle stream, a small purge stream is withdrawn continuously. This purge stream is burned in order to recover heat and metal values from the ash by extraction. Fresh solids are added to the circuit as make-up to maintain the solids content of the system. The solids content of the system can be within the range of 0.5 to 50% but preferably is in the range of 5 to 30%.

The size of the solid additive should be in the range of 2 to 500 meshes. If the solid size is too large, the solid is not very effective because its surface area is small. In addition, it is difficult to handle and transport in the circuit. On the other hand, if it is too small, its separation from the overflow becomes more difficult, and it can be carried into the coker and become a contaminant.

Most of the metal compounds in the resids exists as porphyrins which are decomposed upon heating above about 800° F. The broken compounds can react with radicals in the resids, such as asphaltenes and resins, to form insoluble solid compounds. The broken compounds can also react with solid surfaces of the solids, such as coal, to form insoluble coatings thereon.

Upon separation from the solids, the overflow from the settler is consequently quite low in metals content. It was found that metal removal in this manner can reach over 90%, and 50% metal removal is rather easy. If the overflow is further subjected to solvent deasphalting, the degree of demetallation is nearly 100%.

The solids/liquid separation in this process performs surprisingly well, as long as the temperature of the settler is maintained high enough that the viscosity of the liquid is low. It is because the solid and the liquid are basically incompatible that the solid particles settle down according to Stoke's law.

Visbreaking Conditions

The oil and particulate solids are slurried in a mixing zone and pumped through a visbreaking reaction zone. The weight ratio of resids to coal, when it is used as 100% of the particulate solids, is in the range of about 1.5–10:1.

The step (1) visbreaking heat treatment is conducted at a temperature of about 800°–950° F. and at a weight hourly space velocity of about 1–100.

It is preferred that the visbreaking heat treatment is conducted under a hydrogen partial pressure of about 50–2,000 psi. Addition of steam to the level of about 0.1–5 weight percent of the combined charge stock is also advantageous.

Demetallation occurs at the incipient temperature of coking for the resids, i.e., a temperature above about 800° F. The demetallation proceeds rapidly, particularly because the oil is in contact with solid particles. At 800° F. and above, thermal conversion of the resids yields light distillates. Any coke which is coproduced effectively becomes incorporated in the surrounding matrix of solid particles.

Simultaneously, when coal is all or a portion of the admixed solids, coal depolymerization occurs with the production of gas and liquid constituents. The visbreaking process also operates well because a component of resids is typically a polycyclic aromatic hydrocarbon which can function as a solvent to convert at least a portion of the coal to liquid constituents.

The visbreaker effluent is passed through a high-pressure settler and separator to vent the light end constituents as the first vapor. If hydrogen gas is present, the light end constituents are at least partially recycled to the visbreaking zone. Preferably, the gas/vapor mixture is fractionated by passing it through a condenser to recover the hydrogen gas for recycle and to produce the light end constituents in liquid form.

The process of the instant invention is schematically illustrated in the single figure, comprising a visbreaking unit, a high-temperature settling and separating unit, a coker, and a distillation unit.

Referring to the drawing, resids in line 11 are admixed with a mixture in line 17 which includes steam or hydrogen in line 13, make-up solids additives in line 15, and underflow recycle in line 28. This mixture and the resids are fed to visbreaking heater 21 wherein mild thermal cracking of the residua at visbreaking conditions produces a visbreaker effluent stream carried by line 23 to high-temperature settler and separator 25.

A first vapor product leaves settler/separator 25 through line 31, a liquid product leaves through line 37, and an underflow stream leaves through line 26.

If visbreaking heater 51 is used for hydrovisbreaking, hydrogen is preferably removed from the system by passing the first vapor product from line 31 through line 32 to condenser 33, where water in lines 34 condenses the vaporized light end constituents and permits hydrogen to depart through line 35 to enter line 13. The condensed light end constituents return through line 36 to line 31.

A portion of the underflow is continually withdrawn as a purge stream through line 27 and sent to a combustion unit for heat and metal recovery. The remainder of the underflow passes through line 28 to join make-up additives in line 15 and mix with steam or hydrogen entering through line 13 to form the mixture in line 17 which joins the feed resids in line 11.

The liquid product in line 37 is sent through heater 38 and line 39 to enter coker 41 as feed therefor. Coker 41 may be a delayed coking unit, a fluid coker, or the like. Coker 41 produces a high quality coke product which is withdrawn through line 43 and a second vapor product which is discharged through line 45 to join the first vapor product in line 31, forming a combined feed for distillation column 51. Optionally, however, the combined vapor products may be withdrawn through line 47 for any desired purpose.

Distillation column 51 produces naphtha and light gas which are discharged through line 53, light gas oil which is discharged through line 55, and heavy gas oil which is discharged through line 57. In addition, a certain amount of heavy bottoms are produced and sent through line 59 to join the liquid product in line 37.

What is claimed is:

1. A process for producing low-metal and low-sulfur coke from high-metal and high-sulfur resids which comprises the following steps:

A. heating a feed admixture of said resids, particulate solids, and a gas under visbreaking conditions to form a visbroken admixture;

B. settling said visbroken admixture at high temperature, and separating therefrom a first vapor product, a liquid product, and an underflow stream;

C. heating and coking said liquid product to produce said coke and a second vapor product; and D. distilling said first vapor product and said second vapor product to produce a plurality of demetallized and desulfurized liquid hydrocarbon products.

2. The process of claim 1, wherein said particulate solids comprise coal, coke fines, ashes, iron ore, limestone, dolomite, sand, silica, silica-alumina, and zeolites, and mixtures thereof.

3. The process of claim 2, wherein a purge stream is separated from said underflow stream of Step B as a portion thereof and is burned for heat and metal recovery.

4. The process of claim 3, wherein the remainder of said underflow stream of Step B is recycled and combined with a make-up amount of said particulate solids for admixing with said resids of Step A for forming said feed admixture of Step A.

5. The process of claim 4, wherein steam is admixed with said resids as said gas of Step A and fed to said visbreaking heater as a part of said feed admixture of Step A.

6. The process of claim 4, wherein hydrogen is admixed with said resids as said gas of Step A and fed to said visbreaking heater as a part of said feed admixture of Step A, whereby hydrovisbreaking occurs within said visbreaking heater.

7. The process of claim 6, wherein said first vapor product from said high-temperature settling and separating comprises said hydrogen and is condensed to produce a condensed product and said hydrogen for recycling to said resids of Step A.

8. The process of claim 7, wherein said condensed product is combined with said second vapor product for feeding to said distilling of Step D.

9. The process of claim 1, wherein said plurality of liquid hydrocarbon products of Step D comprises naphtha, light gas oil, and heavy gas oil.

10. The process of claims 1, 5, 8, or 9, wherein said distilling of Step D additionally produces a heavy bottom stream which is recycled for admixing with said liquid product from said high-temperature settling and separating of Step B for feeding to said heating and coking of Step C.

11. A continuous process for producing low-metal and low-sulfur coke of high quality from high-metal and high-sulfur resids and for recovering the metal values of said resids, said process comprising the following steps:

A. heating a feed admixture of said resids, particulate solids, and a gas under visbreaking conditions to form a visbroken admixture;

B. settling said visbroken admixture at high temperature and separating therefrom a first vapor product, a liquid product, and an underflow stream;

C. separating a purge stream from said underflow stream of Step B;

D. burning said purge stream for recovering heat and said metal values;

E. recycling and combining the remainder of said underflow stream of Step B with a make-up amount of said particulate solids of Step A for admixing with said resids and said gas of Step A for forming said feed admixture of Step A;

F. heating and coking said liquid product to produce said high quality coke and a second vapor product; and G. distilling said first vapor product and said second vapor product to produce a plurality of demetallized and desulfurized liquid hydrocarbon products.

12. The process of claim 11, wherein said particulate solids comprise coal, coke fines, ashes, iron ore, limestone, dolomite, sand, silica, silica-alumina, and zeolites, and mixtures thereof.

13. The process of claim 12, wherein:

A. said gas of Step A of claim 11 is selected from the group consisting of steam and hydrogen;

B. said first vapor product from said high-temperature settling and separating comprises said hydrogen and is condensed to produce a condensed product and said hydrogen for recycling to said resids of Step A of claim 11; and C. said condensed product is combined with said second vapor product for feeding to said distilling of Step G.

14. The process of claim 13, wherein said plurality of liquid hydrocarbon products of Step G comprises naphtha, light gas oil, and heavy gas oil.

15. The process of claims 11, 13, or 14 wherein said distilling of Step G additionally produces a heavy bottom stream which is recycled for admixing with said liquid product from said high-temperature settling and separating of Step B of claim 11 for feeding to said heating and coking of Step F.

16. In a process for producing high quality and marketable coke, having low contents of metals and sulfur, from high-metal and high sulfur resids by admixing said resids with particulate solids and a gas which is selected from the group consisting of hydrogen and steam to form a feed admixture, heating and visbreaking said feed admixture to form a visbroken admixture, settling said visbroken admixture at high temperature to produce a vapor product and a bottom product, and coking said bottom product to produce coke and a second vapor product, the improvement which comprises separating said bottom product into an underflow stream and a liquid product which is solely used for said coking.

17. The improved process of claim 16, wherein said underflow stream is separated into a purge stream and a recycle stream which is recycled to and combined with said resids and said gas and a make-up amount of said particulate solids to form said feed admixture.

18. The improved process of claim 17, wherein said particulate solids comprise coal, coke fines, ashes, iron ore, limestone, dolomite, sand, silica, silica-alumina, and zeolites, and mixtures thereof.

19. The improved process of claim 18, wherein:

A. said first vapor product from said high-temperature settling and separating comprises said hydrogen and is condensed to produce a condensed product and said hydrogen for recycling to said resids and forming said feed admixture;

B. said condensed product is combined with said second vapor product to form a distilling admixture; and C. distilling said distilling admixture produces a plurality of liquid hydrocarbon products comprising naphtha, light gas oil, and heavy gas oil.

20. The improved process of claim 19, wherein said distilling additionally produces a heavy bottom stream which is recycled for admixing with said liquid product from said high-temperature settling and separating for feeding to said coking of claim 16.

* * * * *

UNITED STATES PATENT AND TRADEMARK OFFICE

CERTIFICATE OF CORRECTION

PATENT NO. : 4,481,101

DATED : November 6, 1984

INVENTOR(S) : TSOUNG Y. YAN

It is certified that error appears in the above-identified patent and that said Letters Patent is hereby corrected as shown below:

Column 6, line 44, insert --and-- after "Step A".

Signed and Sealed this

*Seventh* Day of *May 1985*

[SEAL]

*Attest:*

DONALD J. QUIGG

*Attesting Officer* *Acting Commissioner of Patents and Trademarks*